US009541346B1

(12) United States Patent
Huang

(10) Patent No.: US 9,541,346 B1
(45) Date of Patent: Jan. 10, 2017

(54) ROTATION-FORCE ADJUSTING DEVICE FOR A TOY GUN

(71) Applicant: KIEN WELL TOY INDUSTRIAL CO., LTD., Tainan (TW)

(72) Inventor: Shun-Chi Huang, Tainan (TW)

(73) Assignee: Kien Well Toy Industrial Co., Ltd., Tainan (TW)

( * ) Notice: Subject to any disclaimer, the term of this patent is extended or adjusted under 35 U.S.C. 154(b) by 0 days.

(21) Appl. No.: 15/016,399

(22) Filed: Feb. 5, 2016

(30) Foreign Application Priority Data

Jul. 27, 2015 (TW) ..... 104212065 U

(51) Int. Cl.
*F41B 11/89* (2013.01)

(52) U.S. Cl.
CPC ..... *F41B 11/89* (2013.01)

(58) Field of Classification Search
CPC ..... F41B 11/89; F41B 7/00
USPC ..... 124/27, 81, 56
See application file for complete search history.

(56) References Cited

U.S. PATENT DOCUMENTS 2,182,369 A * 12/1939 Barron ..... A63B 69/409 124/81
5,791,326 A * 8/1998 Brown ..... F41B 11/642 124/66
8,333,181 B1 * 12/2012 Rice ..... B23P 6/00 124/73
8,418,682 B2 * 4/2013 Halmone ..... F41B 11/55 124/82
8,714,146 B2 * 5/2014 Hu ..... F41A 21/12 124/83
9,103,624 B1 * 8/2015 Kung ..... F41B 11/62
2012/0227221 A1 * 9/2012 Whitaker ..... A61M 39/1011 24/459
2012/0272941 A1 * 11/2012 Hu ..... F41A 21/12 124/83
2015/0059721 A1 * 3/2015 Huang ..... F41A 21/12 124/27

* cited by examiner

*Primary Examiner* — Joshua Freeman
(74) *Attorney, Agent, or Firm* — Alan D. Kamrath; Kamrath IP Lawfirm, P.A.

(57) ABSTRACT

A rotation-force adjusting device for a toy gun has a pressing tube, an adjusting unit, and a gun body. The pressing tube has a pressing block, a cushion hole, and an abutting portion. The pressing block is formed on and protrudes radially inward from a top portion of the inner surface of the pressing tube. The cushion hole is formed through the top portion of the pressing tube. The abutting portion is formed at the top portion of the pressing tube and is formed on the pressing tube above the cushion hole. The adjusting unit is mounted around the pressing tube and has a force ring and a control knob. The force ring is mounted around the pressing tube, and the control knob is mounted through the force ring. The gun body has an inner barrel mounted through the pressing tube.

3 Claims, 9 Drawing Sheets

ROTATION-FORCE ADJUSTING DEVICE FOR A TOY GUN

BACKGROUND OF THE INVENTION

1. Field of the Invention

The present invention relates to a rotation-force adjusting device, and more particularly to a rotation-force adjusting device for a toy gun that may prevent a pellet rubbing against and damaging a pressing block of the rotation-force adjusting device.

2. Description of Related Art

With reference to FIGS. 7 and 8, a conventional rotation-force adjusting device for a toy gun has a pressing tube 70, an adjusting unit 80, and a gun body 90. The pressing tube 70 is a hollow tube and has an ejecting end 701, a gas inlet end 702, a pressing block 71, and an abutting portion 72. The pressing tube 70 is made of rubber. The pressing block 71 is formed on a top portion of an inner surface of the pressing tube 70 and between the ejecting end 701 and the gas inlet end 702 of the pressing tube 70. The abutting portion 72 is formed on a top portion of the pressing tube 70 and above the pressing block 71.

The adjusting unit 80 is mounted around the pressing tube 70 and has a force ring 81 and a control knob 82. The force ring 81 is mounted around the abutting portion 72 of the pressing tube 70. The force ring 81 has an adjusting block 811 and a screw hole 812. The adjusting block 811 is formed on and protrudes radially from a bottom portion of an outer surrounding surface of the force ring 81. The screw hole 812 is formed through the adjusting block 811. The control knob 82 is a screw, has a rotating disk and a screw rod, the screw rod is formed on and protrudes from a top surface of the rotating disk, the screw rod of the control knob 82 is mounted through the force ring 81 and extends upward into the screw hole 812, and this makes the screw rod of the control knob 82 screwed with the screw hole 812 of the adjusting block 811.

The gun body 90 is mounted around the pressing tube 70 and the adjusting unit 80, and the gun body 90 is positioned with the adjusting unit 80. The gun body 90 has an inner barrel 91, two half-shells 92, and an outer barrel 93. The inner barrel 91 is mounted in the pressing tube 70 via the ejecting end 701 of the pressing tube 70, and this makes an internal of the inner barrel 91 communicate with an internal of the pressing tube 70. The inner barrel 91 is made of metal.

The two half-shells 92 cover a back half segment of the inner barrel 91, the adjusting unit 80, and the pressing tube 70. Each one of the two half-shells 92 has a positioning groove 921, a communicating groove 922, and an adjusting groove 923. The positioning groove 921 is transversely formed through a middle section of the two half-shells 92, and the rotating disk of the control knob 82 is positioned in the two positioning grooves 921 of the two half-shells 92. The communicating groove 922 is formed in the half-shell 92 and communicates with the positioning groove 921, and the adjusting block 811 of the force ring 81 and the screw rod of the control knob 82 are positioned in the two communicating grooves 922 of the two half-shells 92.

The adjusting groove 923 is concaved inward from an upper half segment of the half-shell 92 and communicates with a corresponding communicating groove 922. The adjusting groove 923 is formed on the half-shell 92 above the positioning groove 921 and is arc-shaped, and the force ring 81 of the adjusting unit 80 is located in the two adjusting grooves 923 of the two half-shells 92. The outer barrel 93 is mounted around the two half-shells 92, and the inner barrel 91 is located in the outer barrel 93.

With reference to FIGS. 7 and 9, when the conventional rotation-force adjusting device for a toy gun ejects a pellet 60, as the pressing tube 70 is made of rubber and the control knob 82 is mounted through the force ring 81 and extends into the screw hole 812, the rotating disk of the control knob 82 is positioned in the two positioning grooves 921 of the two half-shells 92. When the control knob 82 rotates, as the screw rod of the control knob 82 is screwed with the screw hole 812, this makes the rotating disk of the control knob 82 move upwardly relative to the pressing tube 70 until the control knob 82 abuts a top side of the two positioning grooves 921. The force ring 81 moves toward the control knob 82, and the force ring 81 presses against the abutting portion 72 of the pressing tube 70, so the pressing force is transmitted to the pressing block 71 via the abutting portion 72. When the pellet 60 is ejected and passes through the pressing tube 70, the pellet 60 is forced downwardly when passing through the pressed pressing block 71, and a rotation force is formed with an ejection force and a downward force. Therefore, the pellet 60 is ejected out of the inner barrel 91 in a rotating manner, and this may increase the ejecting length and accuracy of the pellet 60.

However, since a surrounding wall of the pressing tube 70 is solid, when the pressing tube 70 is forced by the force ring 81, a deformation of the abutting portion 72 would affect the pressing block 71 directly, and the pressing block 71 deforms downward. So the pellet 60 is pressed by the pressing block 71, and a rigid contact is formed between the pressing block 71 and the pellet 60. Because the pressing block 71 is made of rubber, in the procedure of ejecting the pellet 60, the pressing block 71 is easily to be damaged due to the friction between the pellet 60 and the pressing block 71. And this would influence the accuracy of the pellet 60 and decrease the ejecting length of the pellet 60, so the conventional rotation-force adjusting device for a toy gun should be improved.

To overcome the shortcomings of the conventional rotation-force adjusting device for a toy gun, the present invention provides a rotation-force adjusting device for a toy gun to mitigate or obviate the aforementioned problems.

SUMMARY OF THE INVENTION

The main objective of the present invention is to provide a rotation-force adjusting device for a toy gun which may prevent a pellet rubbing against and damaging a pressing block of the rotation-force adjusting device.

The rotation-force adjusting device for a toy gun has a pressing tube, an adjusting unit, and a gun body. The pressing tube has a pressing block, a cushion hole, and an abutting portion. The pressing block is formed on and protrudes radially inward from a top portion of the inner surface of the pressing tube. The cushion hole is formed through a top portion of the pressing tube. The abutting portion is formed at the top portion of the pressing tube and is formed on the pressing tube above the cushion hole. The adjusting unit is mounted around the pressing tube and has a force ring and a control knob. The force ring is mounted around the pressing tube, and the control knob is mounted through the force ring. The gun body has an inner barrel mounted through the pressing tube.

Other objects, advantages, and novel features of the invention will become more apparent from the following detailed description when taken in conjunction with the accompanying drawing.

DETAILED DESCRIPTION OF PREFERRED EMBODIMENT

Figure 1:
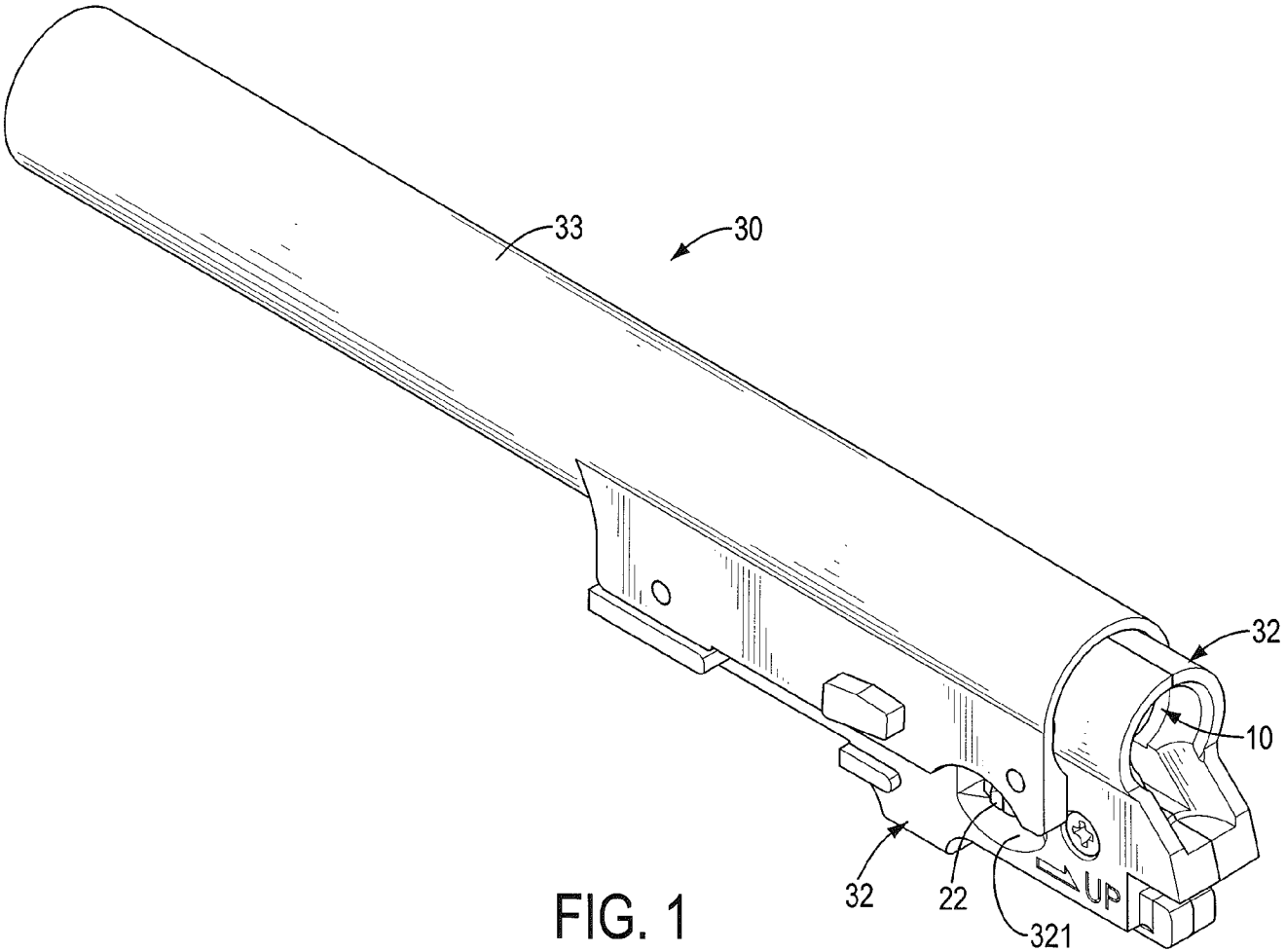
FIG. 1 is a perspective view of a rotation-force adjusting device for a toy gun in accordance with the present invention.
Figure 2:
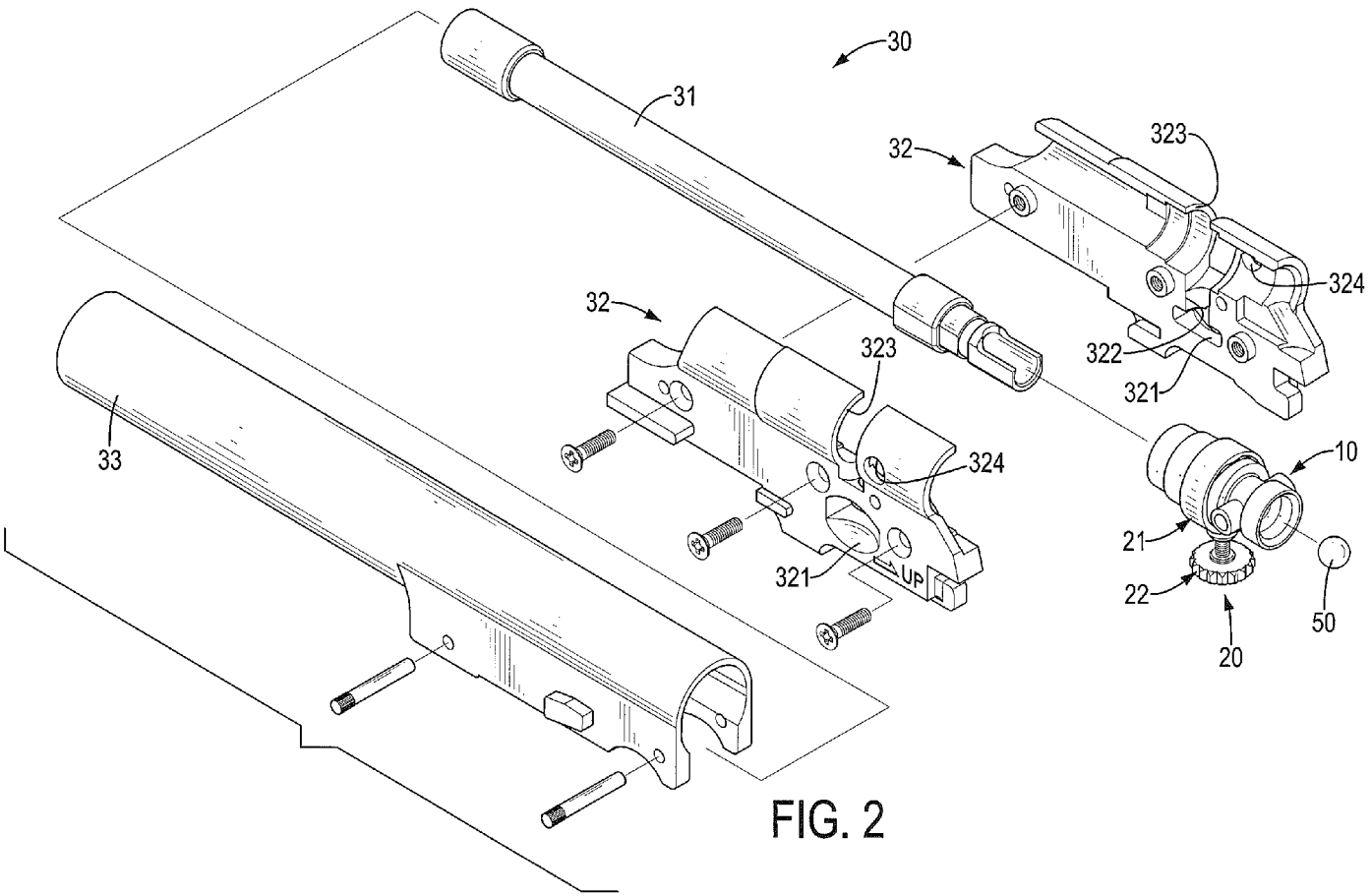
FIG. 2 is an exploded perspective view of the rotation-force adjusting device in FIG. 1.
Figure 3:
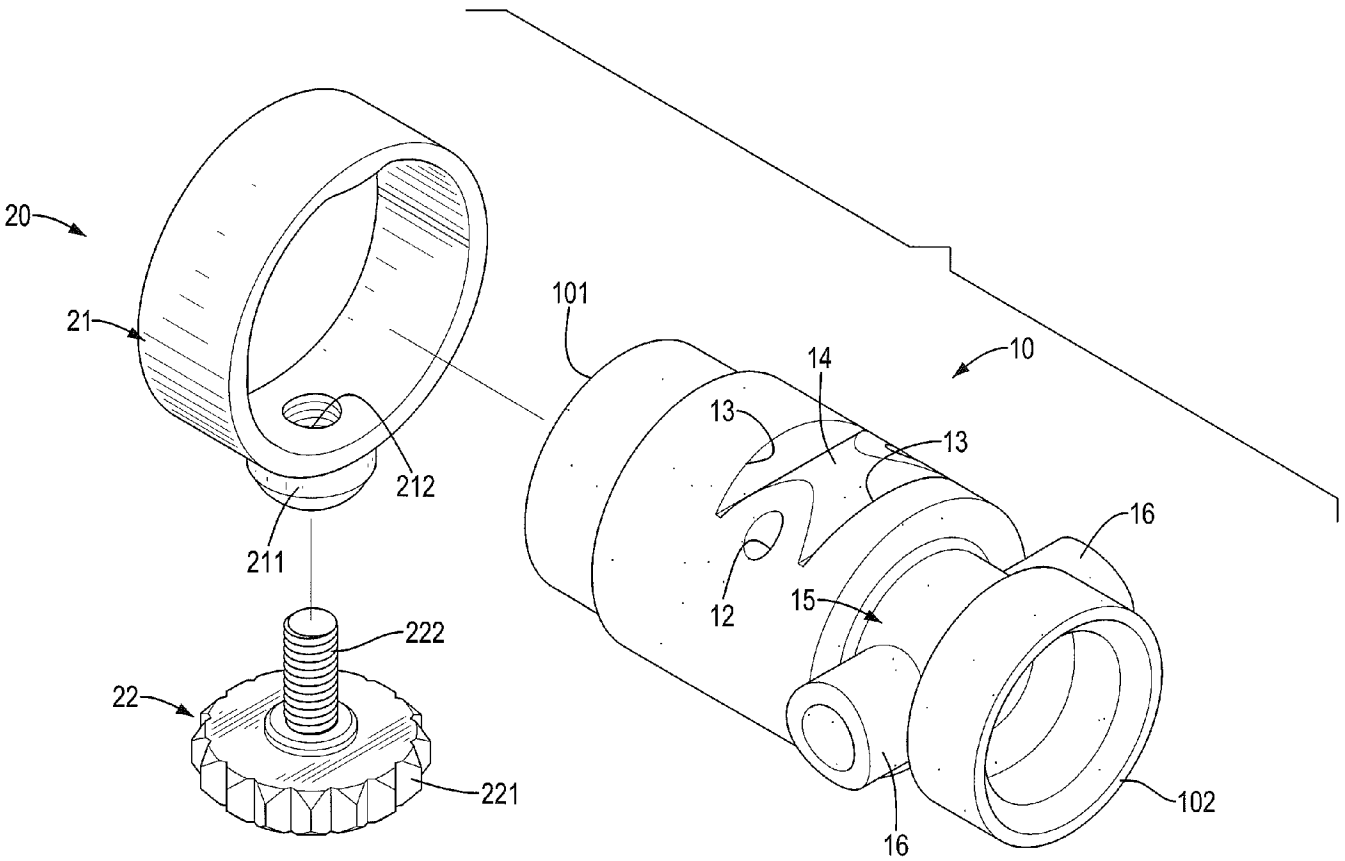
FIG. 3 is an enlarged and exploded perspective view of the rotation-force adjusting device in FIG. 1.

With reference to FIGS. 1 to 3, a rotation-force adjusting device for a toy gun has a pressing tube 10, an adjusting unit 20, and a gun body 30.

Figure 4:
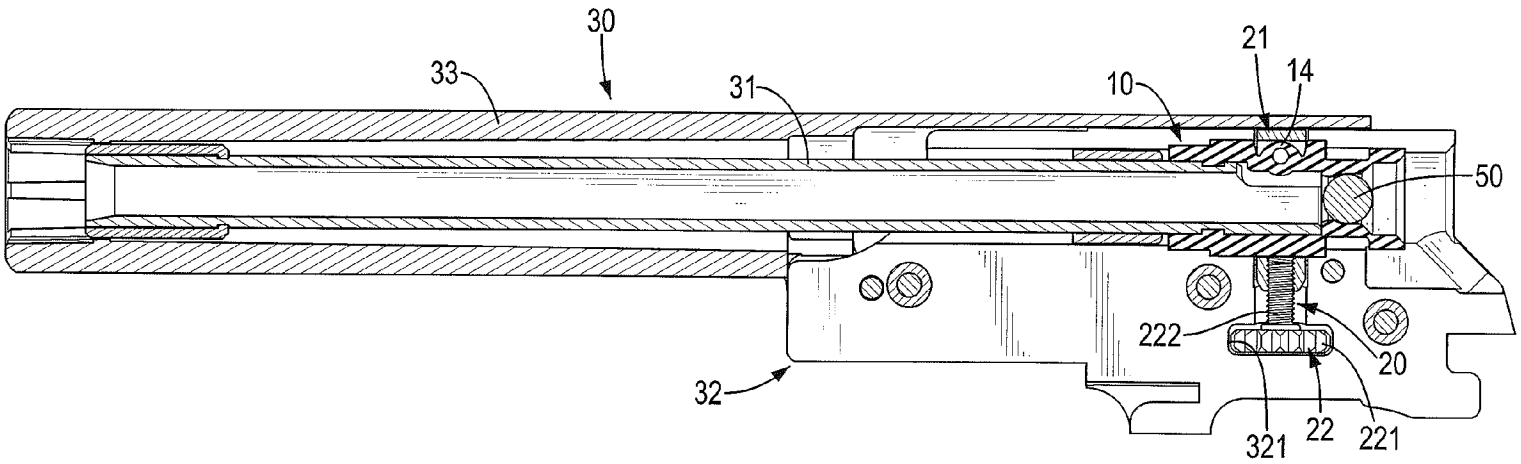
FIG. 4 is a side view in partial section of the rotation-force adjusting device in FIG. 1.
Figure 5:
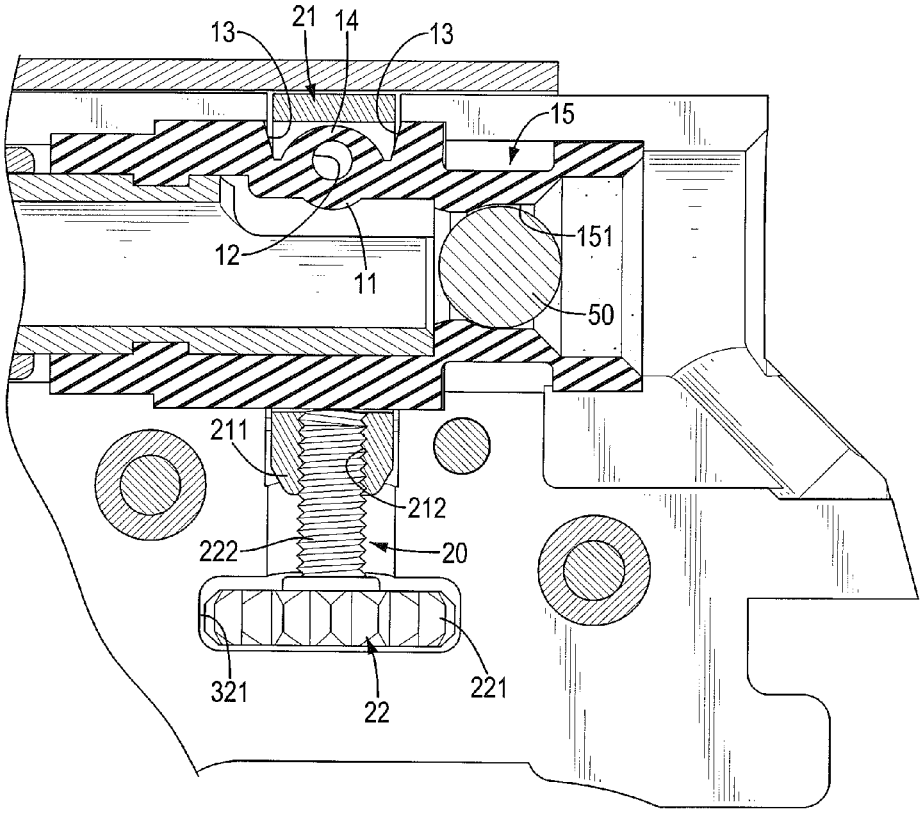
FIG. 5 is an enlarged side view in partial section of the rotation-force adjusting device in FIG. 4.

With reference to FIGS. 2 to 4, the pressing tube 10 is a hollow tube and is made of rubber. The pressing tube 10 has a front end, a back end, an axis, an inner surface, an ejecting end 101, a gas inlet end 102, a pressing block 11, a cushion hole 12, two limiting grooves 13, an abutting portion 14, a pellet engaging portion 15, and two positioning protrusions 16. The ejecting end 101 is formed on the front end of the pressing tube 10, and the gas inlet end 102 is formed on the back end of the pressing tube 10. With reference to FIG. 5, the pressing block 11 is formed on and protrudes radially inward from a top portion of the inner surface of the pressing tube 10, and the pressing block 11 is perpendicular to the axis of the pressing tube 10. The cushion hole 12 is formed through a top portion of the pressing tube 10, the cushion hole 12 is tangent to the top portion of the pressing tube 10, the cushion hole 12 is perpendicular to the axis of the pressing tube 10, and the cushion hole 12 is formed in the pressing tube 10 and above the pressing block 11.

With reference to FIGS. 3 to 5, the two limiting grooves 13 are concaved downward from a top portion of a middle segment of the pressing tube 10, and the two limiting grooves 13 are positioned at a spaced interval. The two limiting grooves 13 are perpendicular to the axis of the pressing tube 10. Preferably, the two limiting grooves 13 are V-shaped grooves. The abutting portion 14 is formed at the top portion of the pressing tube 10 and is formed on the pressing tube 10 above the cushion hole 12. The pellet engaging portion 15 is formed in the pressing tube 10 and adjacent to the gas inlet end 102 of the pressing tube 10, and an inner radius of the pellet engaging portion 15 is smaller than an inner radius of the pressing tube 10 at the pressing block 11. The pellet engaging portion 15 has an engaging recess 151 radially inward formed in the pellet engaging portion 15 and adjacent to the pressing block 11, and a pellet 50 may be located in the engaging recess 151. The two positioning protrusions 16 are formed on and protrude radially from an outer surrounding surface of the pressing tube 10 and are aligned linearly.

With reference to FIGS. 2, 3, and 5, the adjusting unit 20 is mounted around the pressing tube 10 and has a force ring 21 and a control knob 22. The force ring 21 is mounted around the pressing tube 10 between the two limiting grooves 13 and has an adjusting block 211. The adjusting block 211 is radially formed on and protrudes outwardly from a bottom portion of an outer surrounding surface of the force ring 21 and has a screw hole 212. The screw hole 212 is formed through the adjusting block 211 and a bottom of the force ring 21. The control knob 22 is mounted in the force ring 21 and extends through the screw hole 212 and has a rotating disk 221 and a screw rod 222. The screw rod 222 of the control knob 22 is screwed with the screw hole 212 of the adjusting block 211 and the screw rod 222 is formed on and protrudes from a top surface of the rotating disk 221.

With reference to FIGS. 2 to 4, the gun body 30 is mounted around the pressing tube 10 and is positioned with the adjusting unit 20. The gun body 30 has an inner barrel 31, two half-shells 32, and an outer barrel 33. The inner barrel 31 is mounted in the pressing tube 10 via the ejecting end 101 of the pressing tube 10, and this makes an internal of the inner barrel 31 communicate with an internal of the pressing tube 10. The inner barrel 31 is made of metal. The two half-shells 32 are mounted around a back half segment of the inner barrel 31, the adjusting unit 20, and the pressing tube 10. Each one of the two half-shells 32 has an inner surface, a positioning groove 321, a communicating groove 322, an adjusting groove 323, and a locating hole 324.

The positioning groove 321 is formed in the inner surface of the half-shell 32. The positioning groove 321 is covered by the rotating disk 221 of the control knob 22, and this makes the rotating disk 221 of the control knob 22 positioned in the two positioning grooves 321 of the two half-shells 32. The communicating groove 322 is formed in a corresponding half-shell 32 and communicates with the corresponding positioning groove 321. The two communicating grooves 322 are disposed around the screw rod 222 of the control knob 22 and the adjusting block 211 of the force ring 21.

The adjusting groove 323 is formed through an upper segment of the half-shell 32, communicates with the communicating groove 322, and is formed through the half-shell 32 above the positioning groove 321. The adjusting groove 323 is arc-shaped, and the force ring 21 of the adjusting unit 20 is located in the two adjusting grooves 323 of the two half-shells 32. The locating hole 324 is formed through the corresponding half-shell 32 and is adjacent to the adjusting groove 323, the two positioning protrusions 16 are respectively located in the two locating holes 324, and this makes the pressing tube 10 engage with the two half-shells 32. The outer barrel 33 is mounted around the two half-shells 32, and the inner barrel 31 is located in the outer barrel 33.

Figure 6:
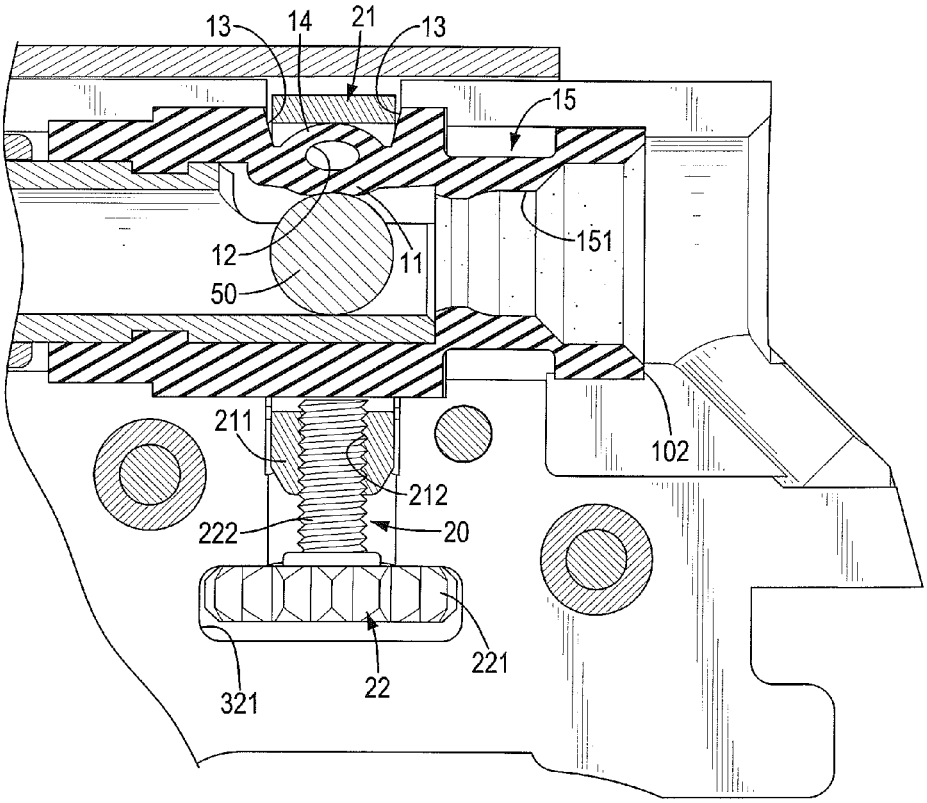
FIG. 6 is an operational enlarged side view in partial section of the rotation-force adjusting device in FIG. 1.
Figure 7:
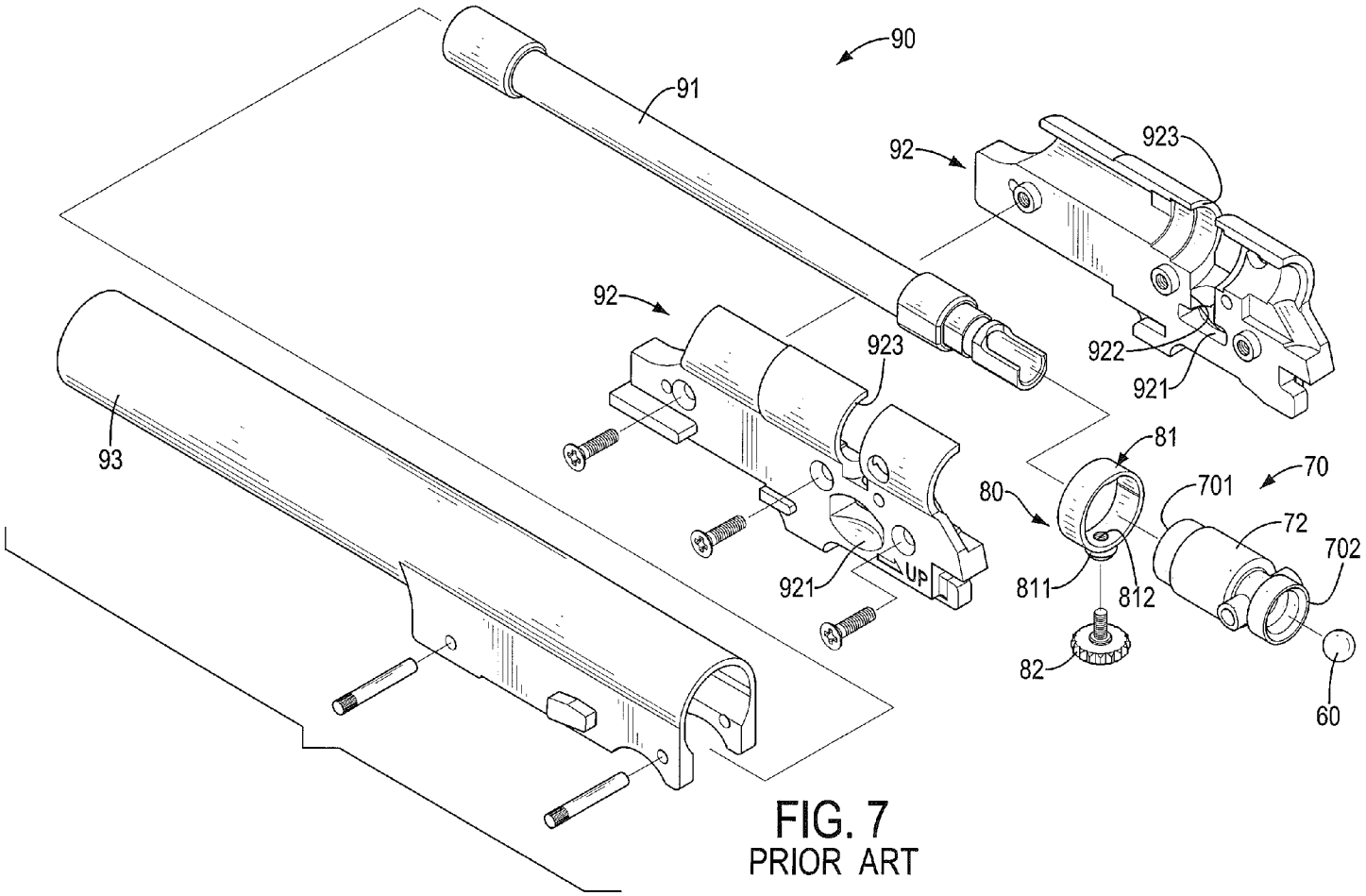
FIG. 7 PRIOR ART
FIG. 7 is an exploded perspective view of a rotation-force adjusting device for a toy gun in accordance with the prior art.
Figure 8:
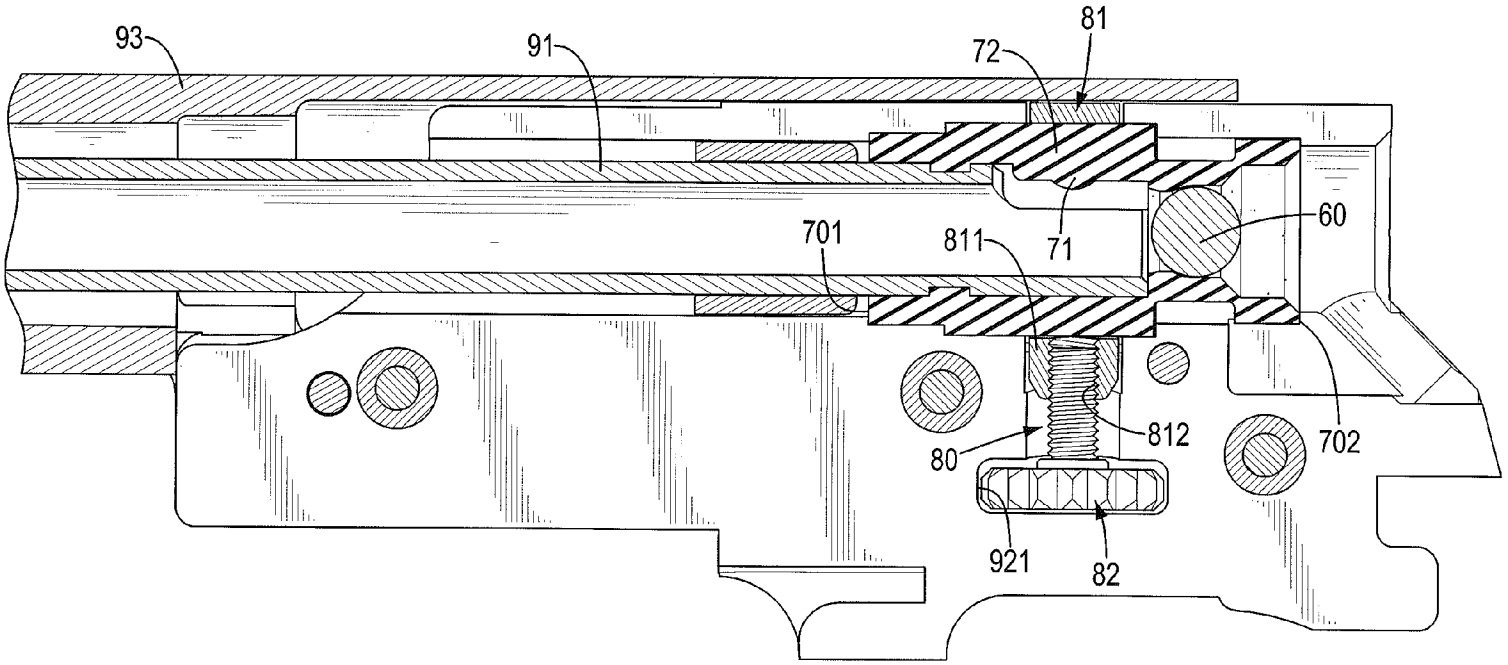
FIG. 8 PRIOR ART
FIG. 8 is an enlarged side view in partial section of the conventional rotation-force adjusting device in FIG. 7.
Figure 9:
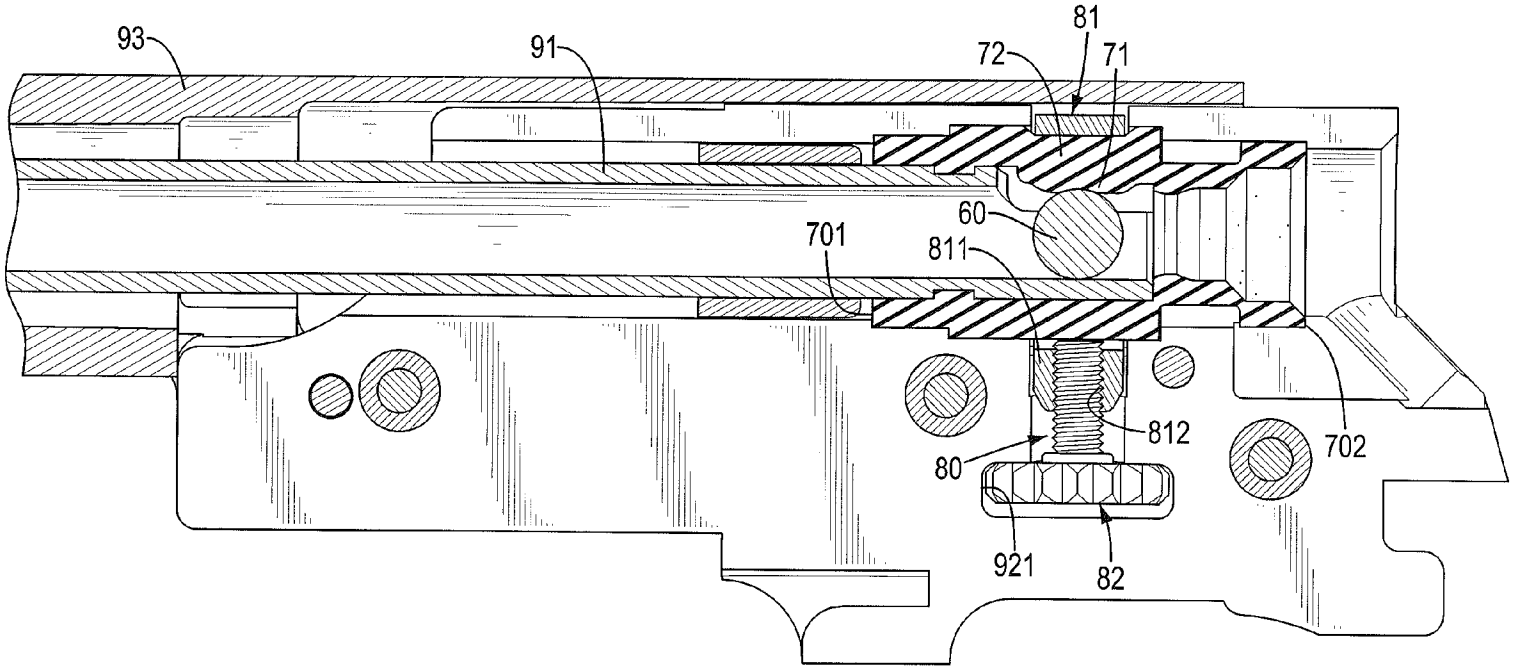
FIG. 9 PRIOR ART
FIG. 9 is an operational enlarged side view in partial section of the conventional rotation-force adjusting device in FIG. 7.

In use, with reference to FIGS. 2, 5, and 6, the rotating disk 221 of the control knob 22 is positioned in the two positioning grooves 321 of the two half-shells 32, the screw rod 222 of the control knob 22 is screwed with the screw hole 212 of the adjusting block 211, and the pressing tube 10 is made of rubber. Thus, when the control knob 22 rotates relative to the two half-shells 32, the rotating disk 221 of the control knob 22 moves upward until the rotating disk 221 abuts two top portions of the two positioning grooves 321, the force ring 21 moves toward the control knob 22 and presses against the abutting portion 14 of the pressing tube 10, so the cushion hole 12 would be deformed. And the deformation of the cushion hole 12 makes the pressed pressing block 11 move downwardly relative to the pressing tube 10. Therefore, when the pellet 50 is pushed to eject by an applied force such as a gas compression force, the pellet 50 moves toward the ejecting end 101 of the pressing tube 10 from the engaging recess 151.

When the pellet 50 passes through the pressing block 11 which moves downward and abuts the pressing block 11, the pellet 50 would be pressed by the pressing block 11 and co-operated with an ejecting force, and the pellet 50 may rotate. When the pellet 50 passes through a middle segment of the pressing block 11, because of the cushion hole 12, the pellet 50 and the pressing block 11 form a non-rigid contact, and a cushion region is formed between the pellet 50 and the pressing block 11. The pellet is applied with a rotation force without over-rubbing the pressing block 11, thereby avoiding damaging the pressing block 11.

Furthermore, the two limiting grooves 13 are perpendicular to the axis of the pressing tube 10, and the forcing region of the force ring 21 would be limited between the two limiting grooves 13, and this can prevent the force of the force ring 21 transmitting out of the two limiting grooves 13 of the pressing tube 10. As for the conventional rotation-force adjusting device for a toy gun, because a surrounding wall of the pressing tube 70 is solid, the abutting portion 72 abuts the pressing block 71 in a rigid contact. The pressing block 70 presses the pellet 60 directly, the pressing block 71 rubs against the pellet 60 directly, and the pressing block 71 is damaged such that the accuracy of the pellet 60 is affected. The design of the cushion hole 12 of the present invention makes the pellet 50 and the pressing block 11 form a non-rigid contact. The applied force between the pressing block 11 and the pellet 50 decreases, so the pressing block 11 would not over-rub the pellet 50. Then, the shooting length and accuracy of the pellet 50 may be improved Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rotation-force adjusting device for a toy gun comprising:

a pressing tube having
- an axis;
- an inner surface;
- an ejecting end;
- a pressing block formed on and protruding radially inward from a top portion of the inner surface of the pressing tube;
- a cushion hole formed through a top portion of the pressing tube, the cushion hole being tangent to the top portion of the pressing tube, the cushion hole being perpendicular to the axis of the pressing tube, and the cushion hole formed in the pressing tube and being above the pressing block;
- an abutting portion formed at the top portion of the pressing tube and formed on the pressing tube and being above the cushion hole;

an adjusting unit mounted around the pressing tube and having
- a force ring mounted around the pressing tube and having
  - an adjusting block radially outward protruding from a bottom portion of an outer surrounding surface of the force ring and having a screw hole, the screw hole formed through the adjusting block; and
- a control knob mounted through the screw hole and having
  - a rotating disk; and
  - a screw rod protruding from a top surface of the rotating disk; and a gun body mounted around the pressing tube and positioned with the adjusting unit and having
- an inner barrel mounted in the pressing tube via the ejecting end of the pressing tube, and an internal of the inner barrel communicating with an internal of the pressing tube; and
- two half-shells mounted around the inner barrel, the adjusting unit, and the pressing tube, each one of the two half-shells having
  - an inner surface;
  - a positioning groove formed in the inner surface of the half-shell, and the rotating disk of the control knob positioned in the two positioning grooves;
  - a communicating groove formed in the half-shell and communicating with the positioning groove, the communicating groove disposed around the screw rod of the control knob and the adjusting block of the force ring; and
  - an adjusting groove formed through an upper segment of the half-shell and communicating with the communicating groove and formed through the half-shell above the positioning groove, and the force ring of the adjusting unit located in the two adjusting grooves.

2. The rotation-force adjusting device for a toy gun as claimed in claim 1, wherein the pressing tube has two limiting grooves concaved downward from the top portion of the pressing tube, and the abutting portion being between the two limiting grooves, the two limiting grooves being perpendicular to the axis of the pressing tube.

3. The rotation-force adjusting device for a toy gun as claimed in claim 2, wherein the two limiting grooves are V-shaped grooves.

* * * * *